US008978220B2

(12) United States Patent
Wendt et al.

(10) Patent No.: US 8,978,220 B2
(45) Date of Patent: Mar. 17, 2015

(54) TOOL AND DIE FOR A RIVETING TOOL

(75) Inventors: Roland Wendt, Argenbühl (DE); Wolfgang Pfeiffer, Markdorf (DE); Michael Badent, Weingarten (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 158 days.

(21) Appl. No.: 13/104,305

(22) Filed: May 10, 2011

(65) Prior Publication Data

US 2011/0277288 A1 Nov. 17, 2011

(30) Foreign Application Priority Data

May 17, 2010 (DE) ..... 10 2010 020 666

(51) Int. Cl.

| | |
|---|---|
| ***B23P 11/00*** | (2006.01) |
| ***B21J 15/02*** | (2006.01) |
| ***B21J 15/16*** | (2006.01) |
| ***B21J 15/18*** | (2006.01) |

(52) U.S. Cl.

CPC ..... *B21J 15/02* (2013.01); *B21J 15/025* (2013.01); *B21J 15/16* (2013.01); *B21J 15/18* (2013.01)

USPC ..... 29/243.53

(58) Field of Classification Search

CPC ..... B23P 11/00

USPC ..... 29/243.53, 243.54, 243.55, 243.56, 29/525.06, 34 B

See application file for complete search history.

(56) References Cited

U.S. PATENT DOCUMENTS

| | | | | |
|---|---|---|---|---|
| 4,064,617 | A * | 12/1977 | Oaks | 29/432.1 |
| 5,263,236 | A * | 11/1993 | Givler | 29/26 A |
| 5,339,509 | A * | 8/1994 | Sawdon et al. | 29/432 |
| 5,519,934 | A | 5/1996 | Dobrikow | |
| 5,528,815 | A | 6/1996 | Webb | |
| 5,531,009 | A * | 7/1996 | Givler | 29/243.53 |
| 5,937,694 | A * | 8/1999 | Mueller | 72/452.1 |
| 7,150,086 | B2 | 12/2006 | Rapp | |
| 7,266,876 | B2 * | 9/2007 | Thompson | 29/509 |
| 7,322,086 | B2 * | 1/2008 | Humpert et al. | 29/243.5 |
| 7,694,399 | B2 * | 4/2010 | Sawdon et al. | 29/243.53 |
| 2004/0182212 | A1 * | 9/2004 | Harris et al. | 83/247 |
| 2006/0248705 | A1 * | 11/2006 | Opper | 29/525.06 |
| 2008/0066286 | A1 * | 3/2008 | Saathoff | 29/432.1 |

FOREIGN PATENT DOCUMENTS

| | | | |
|---|---|---|---|
| DE | 102 14 959 | A1 | 1/2003 |
| DE | 10 2004 015 568 | A1 | 10/2005 |
| EP | 0 546 270 | A1 | 6/1993 |

* cited by examiner

*Primary Examiner* — Lee D Wilson
*Assistant Examiner* — Henry Hong
(74) *Attorney, Agent, or Firm* — Burr & Brown, PLLC

(57) ABSTRACT

A die for a riveting tool for implementing a punch rivet connection between at least two joined part sections is proposed, the die being used in a state provided in the riveting tool for supporting the joined part sections during a connection procedure and a die front side facing toward a movable punch of the riveting tool, using which a rivet element can be pressed in a punching manner through the joined part sections to be connected, an embossing section of the die protruding in relation to adjacent areas of the die front side and causing an embossment in the die-side joined part section, so that components of the joined part material flow into an external depression on the rivet element. According to the invention, the embossing section is implemented as divided into sections. The invention additionally relates to a riveting tool.

18 Claims, 3 Drawing Sheets

TOOL AND DIE FOR A RIVETING TOOL

This application claims the benefit under 35 USC §119(a)-(d) of German Application No. 10 2010 020 666.0 filed May 17, 2010, the entirety of which is incorporated herein by reference.

FIELD OF THE INVENTION

The invention relates to a tool and a die for a riveting tool for implementing a punch rivet connection between at least two joined part sections.

BACKGROUND OF THE INVENTION

When connecting joined parts by punch rivets using a riveting tool, a connection element such as a solid punch rivet is introduced into joined part sections for the spot connection thereof. A solid punch rivet is pressed through the components to be connected using a punch, and the punch rivet connection is prepared in cooperation with the die in the joined parts, which are positioned between a blank holder and the die. The punch rivet is used in particular for connecting multiple sheet-metal layers, the joined parts to be connected not previously having been perforated at the later connection point. The so-called slugs which are punched through out of the material of the joined parts by the solid punch rivet during the punch riveting are discharged on the die side.

In the case of solid punch rivet connections, during the punch riveting, material of the joined parts is pressed using an embossing section of the die into external grooves or depressions provided on the solid punch rivet.

SUMMARY OF THE INVENTION

The object of the present invention is to improve the implementation of a punch rivet connection technically and economically. In particular, longer service lives of the riveting tools are to be achieved or joined parts, of which at least some may comprise a high-strength material, are to be connectable by punch riveting with application of comparatively reduced joining forces.

The invention is primarily directed to a die for a riveting tool for implementing a punch rivet connection between at least two joined part sections, the die being used, in a state provided in the riveting tool, for supporting the joined part sections during a connection procedure and a die front side facing toward a movable punch of the riveting tool, using which a rivet element can be pressed in a punching manner through the joined part sections to be connected, an embossing section of the die protruding in relation to adjacent areas of the die front side and causing an embossment in the die-side joined part section, so that components of the joined part material flow into an external depression on the rivet element. A solid rivet having a notch or groove on the outer side comes into consideration as the rivet element in particular.

A first aspect of the invention is that the embossing section is implemented as divided into sections. In known dies, the embossing section is always undivided or provided as a non-divided die section. The embossing section is permanently connected to the adjacent areas of the die or designed integrally with these areas. Several experiments using dies for punch riveting having an embossing section which is separate from adjacent areas of the die front side have misfired, since these dies are impractical in particular because of stability problems of the embossing section.

The die according to the invention has an embossing section which is divided in such a manner that the embossing section can absorb ultra-high forces in the axial direction. In the axial direction here means in a direction of the movement of the punch for punching or embossing or in a direction of the joining axis. The mechanical stability of the embossing section in the axial direction is thus in the same magnitude as in the case of an embossing section which is solid or is not divided into sections. The division into sections advantageously has a stability-increasing effect in the radial direction and perpendicular thereto or does not have a stability reducing effect in the axial direction, in comparison to a solid or non-divided embossing section. This is because up to this point, there have been tangential tensions which act at least sometimes during the connection procedure in the embossing section, which result in a failure of the embossing section. Cracks or the like then occur.

The radial stability of the die according to the invention is explained as follows: In the radial direction to the joining axis or longitudinal axis of the die according to the invention, a direction-dependent elasticity is implemented in the component of the embossing section, in that a comparatively small restoring yielding behavior of at least one subsection is made possible. Upon load in the axial direction by the punch action, a deviation of a subsection in the radial direction may be in the range of a few hundredths of a millimeter to approximately 0.05 mm, for example. This is sufficient in the case of a divided die to overcome an existing gap between an outer side of the embossing section and an adjoining section of the die main body. With the contact of the embossing section to the solid main body of the die, forces are absorbed and dissipated therein. The main body having its comparatively high stability to the embossing section can readily withstand this load.

A peripheral enlargement of the embossing section in the event of load is connected to the undivided embossing section, comparatively large strains or forces being avoided in the embossing section, which otherwise, if the embossing section is not divided, result in a failure during the connection procedure, in particular due to fracture or cracking of the embossing section, for example.

According to a second aspect of the invention, the embossing section is provided so it is movable on the die. Dies having movable embossing sections contradict findings up to this point, since it is to be expected that a separate provided embossing section would also decisively lose stability with the separation from surrounding sections of the die, which would inevitably result in a premature failure of the embossing section in practical use.

Further advantages may be implemented on the die with the mobility of the embossing section in relation to adjacent areas of the die. Using the die according to the invention having movable embossing section, which is implemented with respect to a stability increase having in particular temporarily acting support means for a support on fixed sections of the die, the preparation of a solid punch rivet connection can be optimized with respect to the method. Up to this point, a satisfactory technical solution has not been provided for both process phases of the punch riveting, i.e., the phase of punching through the solid rivet, and the embossing of the die-side joined part section, for providing the respective optimum die form adapted thereto. This may now be optimally solved by the movable embossing section. Up to this point, the protrusion of the embossing section has been permanently provided, which is connected to disadvantages in particular for the punching, or the areas of the die front side adjacent to the embossing section must be lowered against a high acting counter force, which must be performed using ultra-high forces to be applied on the punch side, or the die is thus built as impractically large and heavy and/or would result in failure of the die or in particular the embossing section.

Using the die according to the invention, comparatively small joining forces must be applied during the punch riveting procedure, even in the case in which high-strength or ultra-high-strength materials are riveted. The die according to the invention combines the advantages of a solid punch rivet die which is divided in the basic construction with the stability of the integral die.

This is because punch riveting having its two fundamentally different process phases places different requirements on the die in particular. According to the invention, the die can be put because of the mobility of the embossing section into an optimized form, in particular of the die front side, in each case for the punching and the embossing. In addition, there is also the advantageous effect that the joining forces do not have to be increased on the die for both process phases, as heretofore in dies having fixed embossing section, until the entire connection procedure after the additional applied forces for punching and embossing is completed. Using the invention, it is possible that the maximum occurring joining force results from the highest individual force of the respective separately running process phases of the punching and the embossing. In particular the frequency of the process interruptions due to repairs or due to failure of the die is thus significantly reduced. The service life of the die, which is not loaded by tangential strains according to the invention, is significantly higher than known dies.

Overall, the die or a corresponding riveting tool can thus be implemented to be lighter, more cost-effective, and in particular having a longer service life. High-strength or differing materials and/or various thicknesses of the joined part sections can also be punch riveted, without die-related compromises having to be accepted with respect to a worsened punch rivet connection. Fundamentally, a use of the die is also possible if, for example, joined part sections made of an ultra-high-strength material or an aluminum material, respectively, is to be connected. Considered over the entire connection procedure, as explained above, a lesser maximum force must be applied in the case of configurations according to the invention in relation to previous configurations. A tool according to the invention can therefore be implemented having smaller drives and/or greater capacities, compared to known tools.

A further aspect of the invention is that the embossing section and a main body of the die are movable relative to one another via a friction bearing, having a bearing gap between the embossing section and the main body, the bearing gap regionally widening in a receptacle space, so that materials pressed into the bearing gap can be discharged from the bearing gap into the receptacle space.

A friction bearing is advantageously simple, robust, and space-saving. It is unavoidable that, for example, contaminants arising during punching, such as material particles or other solid or liquid materials, may penetrate into the bearing gap, which is disadvantageous for the friction bearing. According to the invention, the bearing gap can at least regionally expand into a receptacle space, so that interfering materials can be discharged from the bearing gap into the receptacle space, in particular automatically through the relative movement of the embossing section and main body. In the receptacle space, the interfering or foreign materials are discharged as in a buffer from the area of the bearing gap which is sensitive in relation to foreign materials. The interfering materials can be continuously or discontinuously discharged from the receptacle space. The receptacle space can additionally be implemented for the inspection of the friction bearing or for monitoring a degree of contamination.

It is particularly advantageous that, at least in the area of the embossing section, a material interruption is provided in such a manner that during the connection procedure, at least a subsection of the embossing section comes into contact on sections of the main body of the die, force peaks, which occur during the connection procedure in the embossing section, being reducible. The at least one material interruption thus typically results in elevated elasticity in the embossing section, so that upon load of the embossing section, a peripheral enlargement of at least a subsection of the embossing section and therefore a support effect result, with the above-mentioned advantageous effects on the stability or service life of the embossing section. Because of the only very small yielding distance of a subsection, it is not disadvantageous for the embossing function of the embossing section that the embossing section radially yields by a few hundredths of a millimeter, for example. A support effect of the embossing section on the main body is coupled to the peripheral enlargement by a subsection which elastically springs out, for example. With the support of the subsection, forces are absorbed by the main body or dissipated into mechanically stable further parts of the tool. The embossing section, which can only be adapted in narrow limits in its design because of its function and position or is implemented to have a comparatively small construction, i.e., in particular cannot be stabilized by increased dimensions itself, is relieved.

Furthermore, it is proposed that the embossing section is divided along the periphery in relation to a central longitudinal axis of the die. The peripheral or azimuthal division of the embossing section can comprise one separation point or multiple separation or division points. The division of the ring-shaped embossing section along the periphery can result in a division into two, three, or four parts or in an even larger division number of the embossing section, for example. The division can particularly be uniform or result in equal dimensioned, in particular identical, sections. The peripheral division can at least be a division implemented on the external periphery of the embossing section, but does not necessarily have to be recognizable on an external periphery of the embossing section, but rather can alternatively be further inward. A separation point can be implemented in the interior of the material area of the embossing section, for example, in particular by a material interruption or recess. A material recess runs in particular from a point on the radial interior to a point radially further outward in the embossing section.

Preferably, two adjacent sections of the embossing section are partially separated by a material interruption and are connected to one another via connection areas. A partially coherent structure of the embossing section can thus be achieved, the division into sections being implemented by the material interruptions. An embossing section can optionally be divided into multiple sections, but remain coherent at one part and the sections can remain connected to one another via the connection areas.

A material interruption in the embossing section can run like a slot fully continuously or non-continuously from one axial end up to the other axial end of the embossing section and/or can run fully continuously or non-continuously from a radial inner side to a radial outer side of the embossing section.

Furthermore, it is proposed that two adjacent sections of the embossing section be completely separated from one another by a continuous material interruption. One subsection can thus radially yield separately, without influencing an adjacent subsection. Tensions in the embossing section are thus avoided, which would possibly otherwise arise via remaining material bridges or could possibly otherwise result in failure of the embossing section. Two adjacent sections may optionally be completely separated by the material interruption, all remaining sections may optionally be provided in a sense as individual segments.

Furthermore, it is advantageous for the embossing section to be at least partially slotted in the longitudinal and/or transverse directions. Slots can be configured easily and in extremely tight spaces in various dimensions, e.g., with respect to a slot width or depth. Opposing surfaces can at least temporarily support one another via a slot, which is stabilizing and contributes to precise positioning of the sections. A slot in the embossing section simultaneously allows a relative movement of the sections among one another, however. Slots additionally provide a free volume which goes to zero in the case of precisely fitted formation, so that no cavities are formed within the embossing section, which is advantageous with respect to a possible jamming problem of punched slugs or a contamination hazard, for example.

The embossing section is advantageously provided on a movable die element in the main body of the die, which is at least sometimes coupled to an adjustable control element, so that the height of the embossing section relative to the adjacent areas of the die front side is changeable as a function of a position of the control element. The protrusion of the embossing section relative to the adjacent areas of the die front side is thus dependent on the control element position. The coupling of the control element to the die element or the change of the protrusion height of the embossing section is performed at predefined phases during the punch riveting procedure, for which a higher-order controller for controlling the riveting procedure can be provided, for example. The preparation of a solid punch rivet connection can be optimized with respect to the method using the die according to the invention.

Using the adjustable control element and therefore the changeable contour of the die front side, the die front side can advantageously be provided for the punching in a level or flat support. For the subsequent embossing process, the embossing section, which is used up to this point in its retracted state as part of the planar support during punching, can be put into a protruding position, so that the previously level die front side is put into a contoured form for the embossing procedure. Through the structural separation of the die into various sections, these may also be optimized or controlled independently of one another. In particular, no compromise must be made for the design of the embossing section, because of which the high joining forces occurring during the punching are opposed by an optimized form for embossing. This is because the embossing section must otherwise be designed so stably, for example, that it does not fail during the punching, which opposes an ideal form for the embossing, however.

According to the invention, a further disadvantage of known one-piece dies may be avoided, according to which, because of the embossing section which always protrudes, pre-embossing, i.e., pressing of the embossing section into the die-side material, has heretofore already occurred during the punching.

According to the invention, advantageously, no correlation to the punching force, for example, must be considered, since according to the invention the embossing section does not appear in protruding form. During punching, the process can be performed in a distance-regulated manner, while in contrast a force-regulated manner can be used during embossing. Each process phase can therefore be executed in an ideally controlled manner and an optimum result can thus be achieved.

In addition, it is proposed that the control element be adapted in such a manner that different predefined heights of the embossing section relative to the adjacent areas of the die front side are continuously settable. The die can thus be flexibly used or adapted, in particular optimized in a targeted manner for different joining tasks.

A modified embodiment of the die according to the invention is distinguished in that the embossing section is implemented in such a manner that the embossing section, in a retracted position of the die element in the main body, is at least nearly flush with the die front side. In the process phase of the punching, a continuous or at least nearly flush die front side can thus be provided, since the movable component of the die front side, which is formed by a corresponding front side of the embossing section, is flush with adjacent die front side areas. In particular, in this state the die front side can be a uniform level or planar surface without protrusions or depressions. This is advantageous for continuous support of the joined parts during punching. The embossing section is additionally radially supported via its mentioned axial length in the main body of the die and is thus stabilized against failure.

Fundamentally, for the solid punch riveting, an opening is always left out in the die front side or embossing section, which is necessary for punching through the joined part sections or for removing the punched slugs. For example, a removal channel in the die or the embossing section and the die element, via which the punched slugs are removable, adjoins the opening in the die front side.

Furthermore, it is proposed that the embossing section be separated from the die element. The die element is particularly seated on top on the die element. Using the separation, the embossing section, which is subject to wear during the connection procedure or can be designed differently depending on the joining task, can advantageously be exchanged or replaced separately.

It is also conceivable that the embossing section and the die element are fixedly connected and optionally integrally designed.

The embossing section preferably has a level or flat frontal area, which is oriented parallel to the remaining die front side, so that it forms a flush part of the die front side in the state of the retracted die element.

With respect to the changeability of the die-side protrusion height of the embossing section, the control element is advantageously mounted in such a manner that a direction of a displacement movement of the control element to change the height of the embossing section is transverse to a direction of the movement of the die element. The installation space for the die can thus be kept comparatively small. The control element can extend in an area laterally offset to the longitudinal extension of the die, which is advantageous, for example, in riveting tools like a so-called clamp for riveting. The control element is advantageously designed as a control slide which is movable back-and-forth.

Furthermore, it is advantageous that a base surface of the die element is supported on a floor surface in the retracted position of the embossing section in the main body of the die, the control element being displaceable between the floor surface and the base surface to change the height of the embossing section. In particular, a control slide can cooperate via an inclined surface gearing with the base surface of the die element. A movement coupling of control slide and die element via an inclined surface in particular is thus made possible in a particularly compact manner or with little installation space.

The section of the control slide which is displaceable between the base surface of the die element and the floor surface can optionally be changed or set in its thickness. This is advantageous for the use of the die for different joining tasks. The greater the thickness of the relevant section of the control slide, the higher the settable protrusion height of the front side of the embossing section in relation to adjacent areas of the die front side. It is also conceivable that the retractable section of the control slide has various areas each having a different thickness, so that depending on the slide position of the control slide or the pushed-down part of the section, a protrusion height of the front side of the embossing section in relation to adjacent areas of the die front side depends in each case on the thickness of the section which is pushed down between the base surface and the floor surface or corresponds to the thickness thereof.

According to a variant according to the invention, in a separation area of a punched slug line, a line section which is moved with the embossing section and a line section fixed thereto are provided, a conical collar section being provided on one line section, which is adjacent to a conical funnel section of the other line section matching the collar section, the collar section and the funnel section always being at least partially overlapping, independently of the position of the entrained line section, in longitudinal extension of the punched slug line. A simple and effective jamming guard can thus be provided in the separation area of the punched slug line. This is because, depending on the protrusion height of the embossing section to adjacent die front side areas, a gap width of varying size is provided in the longitudinal direction of the punched slug line, the gap width alternately growing and shrinking during connection procedures. This is induced by a stroke movement of the embossing section or the die element, a geometrical length of the punched slug line of a slug channel changing, for example. A risk of jamming of slugs or slug parts in the changing inclined separation gap is minimized during the punch riveting by the collar section and the funnel section. The collar section is preferably formed on the base surface of the die element in the transition area to the floor surface, on which the funnel section is provided. The collar section and the funnel section are each particularly provided as closed concentrically around a hole, in the die element and in the floor surface, belonging to the punched slug line.

In addition, it is particularly advantageous that a spring configuration acting on the embossing section is provided, by which, if a force load on a front side of the embossing section falls below a predefined force load, the embossing section can be put in a position protruding beyond adjacent areas of the die front side. Using the spring configuration, a predefined force is particularly permanently applied to the die element or to the embossing section, which has a substantial force component in the direction of the movement of the die element or the embossing section in the die main body to reach the protruding position. With unloaded embossing section, the embossing section therefore protrudes maximally in relation to adjacent areas of the die front side under the effect of the spring force in particular. The embossing section can stand on a mechanical stop.

If, for example, before beginning a punch rivet connection, a joined part section or a die-side joined part is laid on the embossing section, when appropriate spring force is applied, the embossing section having the placed joined part sections is displaced downward against the spring force of the spring configuration until the adjacent frontal areas to the embossing section are flush with the front side of the embossing section, so that an optimum geometry of the die front side for punching can be provided with flat support of the joined part sections before beginning the punching.

If, after the punching procedure, the punching force acting on the joined part sections to be connected or the die via the punch is withdrawn in a subsequent relief phase, because of the pre-tensioned spring configuration, the embossing section together with the joined part sections are put upward in the protruding position in relation to the adjacent areas of the die front side. The free space required for this purpose on the punch side or above the joined part sections is provided in that the punch was previously raised somewhat from the punched-in rivet element or from the punch-side joined part section with the relief. In order that, in the subsequent embossing procedure with further applied punch-side force, the embossing section is not pressed downward into the position retracted into the die main body via the punch, before the embossing, the control slide is displaced below the die element or between its base surface and the floor surface. The control slide advantageously does not have to be moved using high force, since the force for raising was already provided by the spring configuration and the die element is already raised. The control slide must only still be displaced into the gap formed between base surface and the floor surface. The drive of the control element can thus be designed to be relatively small, which is cost-effective and advantageous for the space requirement for the drive of the control element.

Because of the retracted control slide, in the subsequent embossing procedure, the embossing section protruding on the die front side can no longer yield.

The spring configuration preferably comprises a leaf spring which engages from the side on the die element. This is a particularly simple and space-saving configuration. The spring force of the leaf spring can be a fraction of the force to be applied by the punch during punching or embossing, so that the leaf spring can be dimensioned to be comparatively small and light.

With respect to the mounting of the embossing section, it is advantageous that the friction bearing comprises separate opposing friction bearing surfaces on the embossing section and on the main body of the die due to the bearing gap, the receptacle space being formed by a material removal on the friction bearing surface of the embossing section. Alternatively or additionally, a material removal can be provided on the friction bearing surface of the main body. The shape or size of the receptacle space can thus optionally be subsequently performed on an already functional die having movable die element including embossing section.

It is additionally advantageous that the embossing section has a front end section, on which a main section of the embossing section adjoins, an external dimension of the main section being greater than an external dimension of the front end section. The embossing section can thus be dimensioned small in the front part, which presses into the die-side joined part section, on the one hand, and can be reinforced by the main section so it is stable, on the other hand. The main section is supported in particular on the front end of the die element. If the embossing section is divided, the material interruptions or recesses are typically provided in both the front end section and also the main section. If the embossing section is in its completely protruding position to adjacent areas of the die front side, the main section typically remains completely sunken into the die main body, i.e., only a part of the embossing section which is active in embossing protrudes.

The invention additionally relates to a tool for implementing a punch rivet connection between at least two joined part sections having a monitoring unit for monitoring the tool operation, having a movable punch and an opposing die, between which the joined part sections to be connected can be positioned during the connection procedure, a rivet element being able to be pressed using the punch in a punching manner through the joined part sections to be connected, and the die, to support the joined part sections during a connection procedure, having a die front side which comprises an embossing section, which protrudes in relation to adjacent areas of the die front side, for embossing die-side joined part material during the connection procedure, so that as a function of a protrusion height of the embossing section, an embossment results in the die-side joined part section, through which components of the joined part material flow into an external depression on the rivet element. The monitoring unit can be a control and/or regulating unit, for example. According to the invention, one of the above-mentioned dies is provided on the tool. The advantages described above may thus be implemented on the tool.

It is particularly preferable for the monitoring unit to be implemented to perform the connection procedure sequentially in multiple phases, two joining phases being separated by a relief phase and, in the relief phase, a load applied in the preceding joining phase by the tool on the joined part sections being at least partially withdrawn. Therefore, a relief of the joined part sections and thus the embossing section or the die is achieved using the relief phase. The punching procedure, which is distinguished by comparatively high joining forces, is thus more or less separated from the embossing procedure, which also requires relatively high punch forces, by the relief phase having a punch force which disappears nearly completely in relation to the joining phases. The two joining phases of the punching and embossing must provide forces which are primarily required for joining the joined part sections, while in contrast the relief phase is essentially used for changing over the form of the die front side, at least no substantial punch forces being able to act at this time. The separation of the phases is implemented in particular via the movement distance or movement direction of the punch.

The monitoring unit is accordingly implemented, after a first phase of the punching procedure, to reduce a compression force acting on the joined part sections to be connected, so that due to a restoring force acting on the embossing section, the embossing section having the joined part sections supported thereon is raised. The embossing section together with the joined part sections resting thereon can thus be brought into a protruding position, which is optimal for the subsequent embossing, in relation to adjacent die front side areas. The relief required for this purpose in the relief phase is in particular characterized by a twofold reversal of the movement direction of the punch within a complete connection procedure. The programming stored in the monitoring unit is especially adapted to the associated sequence of control commands.

Finally, it is further advantageous that the monitoring unit is implemented to perform the embossing procedure by introducing a compression force acting in the joining direction on the joined part sections. The joining can be performed using an embossing force solely required for the embossing and advantageously, due to the sequential execution, does not have to be initiated by an addition of an auxiliary force or increase of the already applied and continually acting force of the preceding punching procedure, as is the case using known solid punch riveting tools. According to the invention, the load applied during the punching is therefore advantageously no longer provided during the embossing, since the corresponding remaining force was already withdrawn from the embossing section in the relief phase. The reduced load of the embossing section results in a longer service life of the embossing section or the tool.

BRIEF DESCRIPTION OF THE DRAWINGS

Further features and advantages of the invention are explained in greater detail on the basis of the schematic exemplary embodiments of objects according to the invention shown in the figures.

DETAILED DESCRIPTION OF THE INVENTION

The same reference signs are partially used in the figures for corresponding components of different exemplary embodiments.

Figure 1:
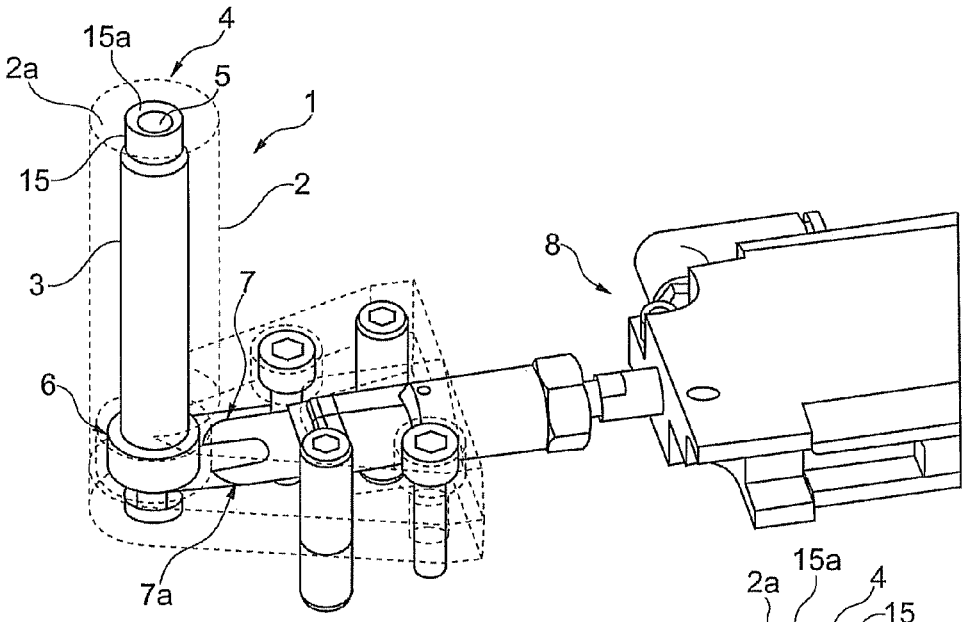
FIG. 1 shows a part of a riveting tool according to the invention having a die in detail, individual sections only being indicated by their boundary profile.

FIG. 1 shows a perspective view diagonally from the side of a part of a riveting tool according to the invention for solid punch riveting using a controlled solid punch rivet die 1, further parts of the riveting tool, such as a blank holder and a punch, not being shown, as well as joined part sections to be connected using a riveting tool.

The solid punch rivet die 1, which is opposite to the punch with blank holder in the complete riveting tool, comprises an essentially cylindrical main body 2, in which a die element 3 having an embossing section 15 is mounted so it is displaceable but captive in the longitudinal direction of the main body 2. A level front side 15*a* of the embossing section 15 and a level front side 2*a* of the main body 2 together form a die front side 4, on which the joined part sections to be connected rest or a bottom side of a die-side joined part section is supported during the connection procedure. The die front side 4 has a central hole 5, which extends in cylindrical form centrally through the embossing section 15 and the die element 3. The hole 5 approximately corresponds in its diameter to an external diameter of the riveting punch (not shown), so that a material or punched slug 20 of the joined part sections, which is punched out during the punching procedure (see FIG. 10), can be discharged downward via the hole 5, which is open on the bottom, when a rivet element (also not shown) is pressed through the joined part sections to be connected. The die element 3 is movement-limited in its movement upward in the direction toward a punch via an externally provided attachment 6 in a base area of the die element 3 and a corresponding counter attachment in the main body 2. The movement of the die element 3 is delimited on the bottom by a top side 10 of a housing component 11 of the solid punch rivet die 1.

The embossing section 15, which is not shown as divided in FIGS. 1 to 5 for simplicity, is divided into sections for reasons of stability, which is shown and explained in particular on the basis of FIGS. 6 to 8 and 11.

Figure 2:
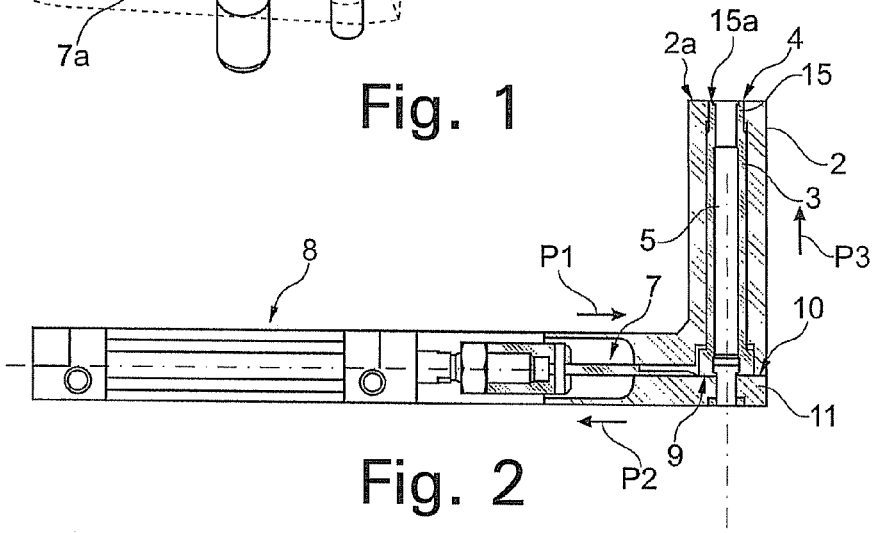
FIG. 2 shows a sectional view through the part of the riveting tool having die according to FIG. 1.
Figure 3:
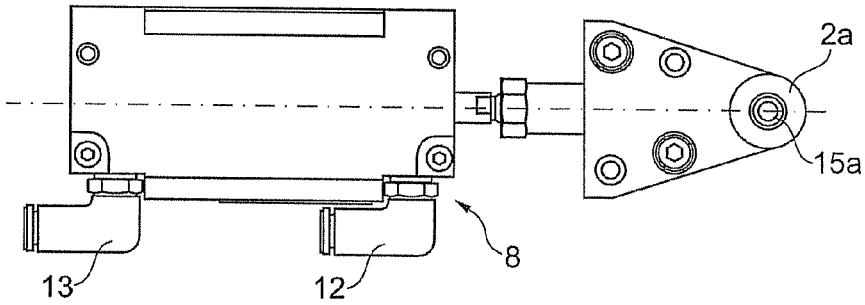
FIG. 3 shows a top view of the configuration according to FIG. 2.

The solid punch rivet die 1 comprises an adjustable control element, which is implemented as a control slide 7, and which is movable via a pneumatic configuration 8 according to the movement arrow P1 (FIG. 2 and FIG. 3) in the direction toward a base of the die element 3 and is movable back in the opposite direction according to movement arrow P2. The control slide 7 is provided on the front with a bevel 7*a*, which comes into contact with a bottom-side base surface 9 on the die element 3 during a forward movement. The die element 3 is moved out of the retracted position shown in the main body 2, as shown in FIGS. 1 to 3, vertically or transversely to the movement direction according to movement arrow P1, upward according to movement arrow P3, so that the embossing section 15 or the front side 15*a* thereof comes, displaced upward, to the fixed-position front side 2*a* of the main body 2, this position not being shown in the figures. The maximum achievable protrusion height of an embossing section 15 protruding in this way corresponds to the height of the front part of the control slide 7, which can have a height between approximately 0.5 to 0.8 mm, for example. The base surface 9 at the lower end of the die element 3 rests or is supported on the top side 10 in the position of the die element 3 shown in the figures. The front end of the control slide 7 having the bevel 7*a* is additionally provided with a U-shaped recess, so that the hole 5 remains continuous for the removal of punched-out material slugs in the retracted state of the control slide 7 below the die element 3.

In the recessed state of the die element 3 according to FIGS. 1 and 2, the front side 15 of the embossing section 15*a* is flush with the front side 2*a* of the main body 2. A plane over the entire area or a flush die front side 4 for the support of the bottom side of the joined part sections to be connected to one another is thus provided in the punching phase of the connection procedure.

The pneumatic configuration 8 is supplied via pneumatic connections 12 and 13 using pneumatic lines.

Figure 4:
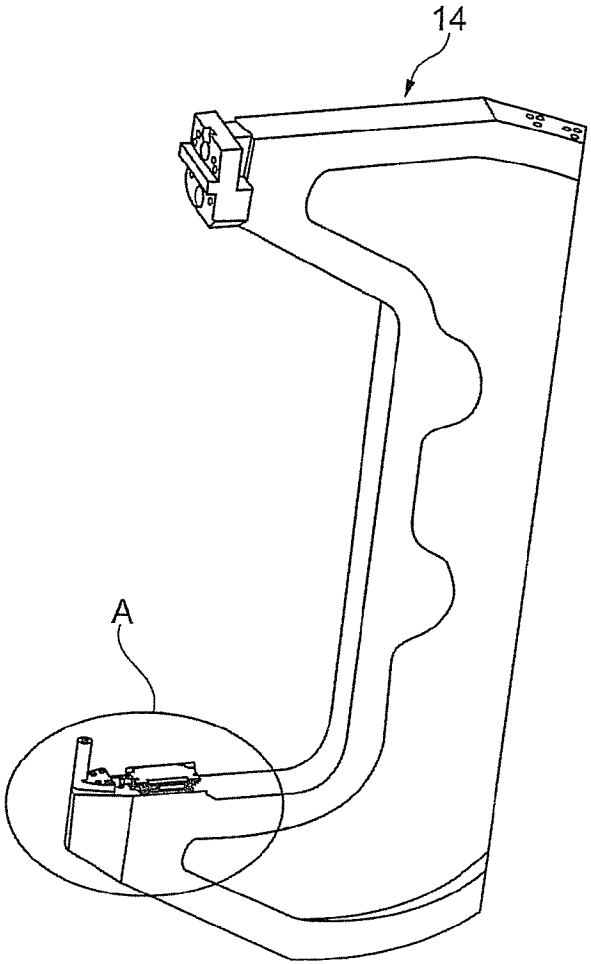
FIG. 4 shows the configuration according to FIGS. 1 to 3 in a state received on a receptacle of a riveting tool, punch-side parts of the riveting tool being omitted.

The configuration according to FIGS. 1 to 3 can be attached at one end to a bow-shaped receptacle 14 of a riveting tool (partially shown in FIG. 4).

Figure 5:
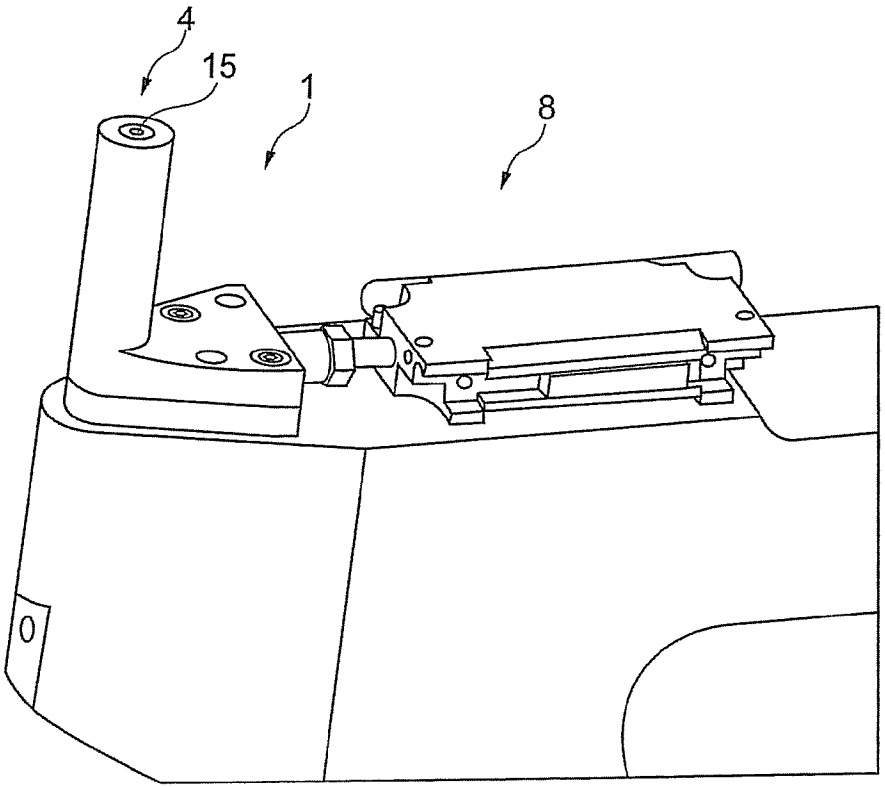
FIG. 5 shows a detail according to area A from FIG. 4.

FIG. 5 shows an enlarged view of the circled area A from FIG. 4 having the solid punch rivet die 1 on the receptacle 14, the receptacle 14 being shown without a punch having blank holder.

In the sequential punch riveting procedure according to the invention, the joined part sections to be connected are first clamped and fixed in position by a blank holder in the closed state of the riveting tool, a bottom side of the die-side joined part section resting on the level die front side 4 according to the implementation from FIGS. 1 to 5. In the closed punching position of the riveting tool 14, a solid punch rivet is then punched through the joined part sections to be connected or sheet-metal layers, for example, using the punch, a force $F_{max}$ representing a punching force and the movement of the punch being able to be performed in a force-monitored manner.

The riveting tool is subsequently relieved in a relief phase, in particular extended by a predetermined distance or amount of a maximum protrusion height of the embossing section 15 in relation to the front side 2*a*. The embossing section 15 is implemented as a ring-shaped component having a central hole, which is clear in particular from FIGS. 7 to 9 and 11. With extended riveting tool, starting from the state shown in FIGS. 1 to 5, the control slide 7 is displaced into an end position in the direction of the movement arrow P1, the die element 3 being moved upward according to movement arrow P3 and a predefined protrusion height of the embossing section 15 being reached. The riveting tool is now closed again and acts on the punch side on the joined part sections using a maximum embossing force in a distance-monitored manner, for example, or presses the joined part sections downward, so that the now fixed embossing section 15 presses using its part protruding in relation to the front side 2*a* into the die-side joined part section and forms a ring-shaped embossment on the bottom side around the introduced rivet element. Material of the die-side joined part section flows into at least one depression or groove provided externally on the solid punch rivet.

Figure 6:
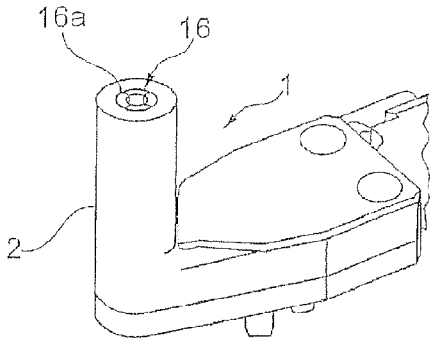
FIG. 6 shows a perspective exemplary embodiment of a part of a riveting tool according to the invention.

FIG. 6 shows a variant of a solid punch rivet die 1. The solid punch rivet die 1 has a divided embossing section 16, which is ring-shaped and is divided via a bearing gap 16*a* into four identical sections or segments, which can spring outward elastically radially to the main body by a few hundredths of a millimeter, for example, when an axial load acts on the embossing section 16 because of a punch force. A slight temporary peripheral enlargement of the embossing section 16 is connected to the springing out, which has the result that the springing-out sections of the embossing section 16 come into contact on the interior of a hole wall in the main body 2. The sections are thus supported on the main body, forces being absorbed by the very mechanically stable main body 2 and the embossing section 16 absorbing no substantial forces itself. The embossing section 16 is thus protected against failure or mechanically kept below a critical load, so that in particular no cracking occurs in the embossing section 16.

Figure 7:
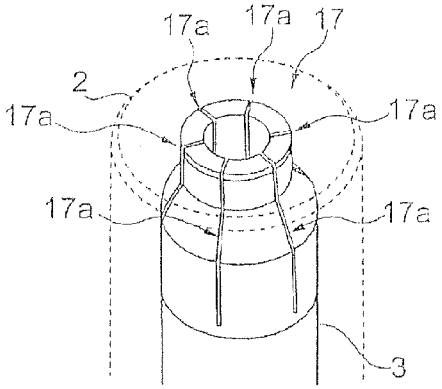
FIGS. 7 and 8 show two exemplary embodiments of the die according to the invention in a perspective partial view, parts of the die only being indicated by their boundary profile.
Figure 8:
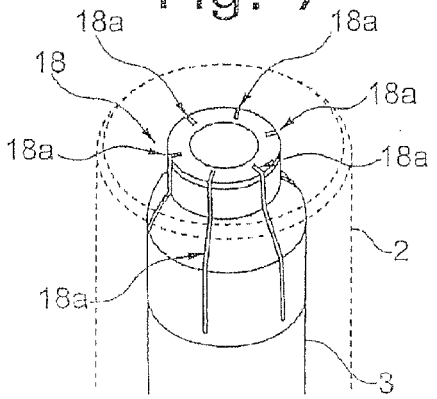

FIG. 7 shows a six-part embossing section 17 in the spring plate principle having slotted material recesses 17*a*, and FIG. 8 shows a further six-part embossing section 18 having alternatively implemented slotted material recesses 18*a* in the diaphragm function.

The embossing section 17 has material recesses 17*a*, which are not completely continuous in the axial direction, but which run completely continuously radially over the wall thickness of the embossing section 17.

Vice versa, the embossing section 18 is provided in the axial direction with completely continuous material recesses 18*a*, which are not completely provided radially over the wall thickness of the embossing section 18, however.

Figure 9:
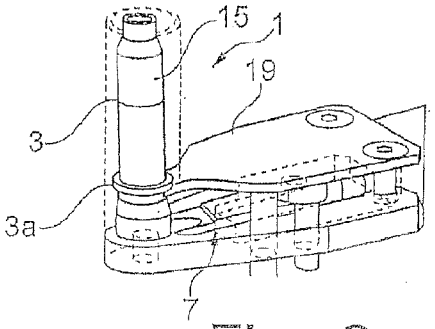
FIG. 9 shows a further variant of a riveting tool according to the invention in a partial view, areas only being indicated by their boundary profile.

According to FIG. 9, a solid punch rivet die 1 is shown, in which a preferred position (not shown) of the embossing section can be configured in the position "extended" or "protruding" in relation to adjacent areas of a die front side by using a solid spring element such as a compact leaf spring 19. The leaf spring 19 is received fixed on components of a housing of the solid punch rivet die 1. A forked end of the pre-tensioned leaf spring 19 engages below or around a part of an external ring 3*a* on the die element 3, so that if the embossing section 15 is not loaded, it is raised jointly with the die element 3. In this way, the pneumatic cylinder does not have to overcome high resistances to move the control slide 7 which is also provided or does not raise the die element 3 including embossing section 15 placed thereon, but only moves the front part of the control slide 7 as the distance below the embossing section 15 raised using the leaf spring. In this way, a significant increase of the process stability can be achieved. Due to the embossing section, which is always extended when relieved, in the case of robot programming during learning or "teaching" of the joining position, the correct or maximum protrusion position of the embossing section 15 is also automatically set reproducibly.

Figure 10:
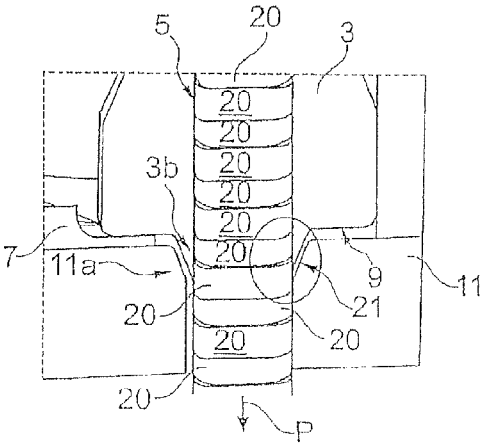
FIG. 10 shows a further detail of a die according to the invention in a partial view in section.

FIG. 10 shows an enlarged sectional view of the housing component 11 and the lower end of the die element 3 and illustrates an advantageous detail of a slug removal of a solid punch rivet die 1 according to the invention. Multiple slugs 20, which have arisen during solid punch riveting with the punching of the rivet element through the joined part sections, are shown and positioned one over another in the hole 5 used as the slug channel. The geometrical length of the slug channel or the hole 5 changes due to the stroke movement of the die element 3. The state having retracted control slide 7 is shown in FIG. 10. At the lower end of the die element 3, between the base surface 9 and the fixed housing component 11 or in the area of the hole 5 at the mentioned separation point, a gap, which opens and closes again or becomes wider and narrower during riveting, is to be observed, with the risk of jamming of slugs or slug parts.

A conical slot 21 can be formed by a peripheral conical bevel of the hole 5, implemented as a funnel section 11*a*, in the housing component 11, and by a conical ring section on the base surface 9 implemented adapted thereto as a collar section 3*b* protruding in the axial direction. The slot 21 prevents jamming of foreign bodies or slugs and slug sections in the transport direction P of the slugs 20 in operation of the tool. Through the intrinsic movement of the slugs, they are automatically pushed back out of the conical slot 21. The conical slot 21 is emphasized in FIG. 10 by a circle.

Figure 11:
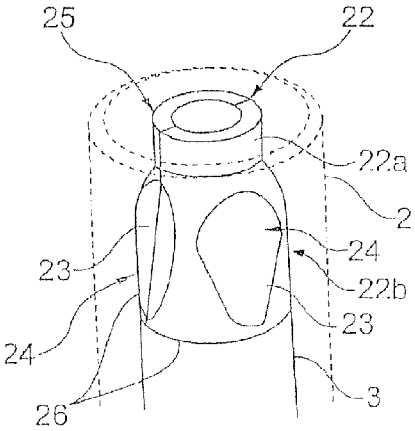
FIG. 11 shows a further die according to the invention in a perspective partial view, parts of the die only being indicated by their boundary profile.

FIG. 11 shows a variant according to the invention of a two-part embossing section 22 having a front end section 22*a* and a main section 22*b* in the main body 2. A friction bearing 26 having a bearing gap 25 is implemented between the embossing section 22 and the main body 2. Flat stop surfaces 23 which run diagonally outward are implemented on the main section 22*b*, so that contaminant pockets 24 are provided between the cylindrical inner wall of the main body 2 and the stop surfaces 23. The end locations of the movement of the die element 3 in the main body 2 can thus be prevented from changing due to contamination or a contaminant buildup. Otherwise, the required force for moving the die element 3 can increase. A reduction of the real applied surface of a top dead center stop can be achieved by the contaminant pockets 24, in order to significantly increase the contact pressure between the parts pressing against one another. A contaminant displacement into the adjacent free spaces of the contaminant pockets 24 can thus be achieved, which act as a buffer for receiving contaminants. Possibly occurring intervals between cleaning measures can thus be lengthened.

The provision of other spaces for receiving contaminants is also conceivable to lengthen occurring cleaning intervals. For example, this can be implemented by a spiral coil, notches, or pockets between the die element 3 and the main body 2.

The connection of these pockets to the external surroundings both as an outlet for the contaminants and also for the visual indication for a necessary cleaning or only as outlet openings for contaminants without pockets and optional cleaning using a flushing medium during docking, for example, are conceivable.

According to the invention, using the above-mentioned detailed solutions, a high service life of the embossing section of a solid punch rivet die can advantageously be achieved overall, in spite of high load, with high process stability. In addition, the solid punch rivet die according to the invention requires a small installation space with high external robustness and reduced contaminant sensitivity behavior.

LIST OF REFERENCE NUMERALS

1 solid punch rivet die
2 main body
2*a* front side
3 die element
3*a* outer ring
3*b* collar section
4 die front side
5 hole
6 attachment
7 control slide
7*a* bevel
8 pneumatic configuration
9 base surface
10 top side
11 housing component
11*a* funnel section
12, 13 pneumatic connection
14 receptacle
15 embossing section
15*a* front side
16 embossing section
16*a* bearing gap
17 embossing section
17*a* material recess
18 embossing section
18*a* material recess
19 leaf spring
20 slug
21 slot
22 embossing section
22*a* end section
22*b* main section
23 bevel surface
24 contaminant pocket
25 bearing gap

We claim:

1. A die for a riveting tool for implementing a punch rivet connection between at least two joined part sections, the die comprising:

a stationary die main body that, when provided in the riveting tool, supports the joined part sections during a connection procedure, the die main body having a die front side facing toward a movable punch of the riveting tool, with which a rivet element can be pressed in a punching manner through the joined part sections to be connected; and an embossing section arranged radially inwardly from adjacent areas of the die front side, wherein the embossing section is movable within the die main body between a retracted position and a protruded position where a portion of the embossing section protrudes upwardly in relation to the adjacent areas of the die front side, wherein, when in the protruded position during the connection procedure, the outer surface of the embossing section directly contacts an inner surface of the die main body and causes an embossment in the die-side joined part section, so that components of the joined part material flow into an external depression on the rivet element, and wherein the embossing section is implemented as divided into sections that define an axial hole extending through the center of the embossing section to receive slugs that are removed from the at least two joined part sections through action of the rivet element.

2. The die according to claim 1, wherein the embossing section is provided so it is movable on the die.

3. A die for a riveting tool for implementing a punch rivet connection between at least two joined part sections, the die comprising:

a stationary die main body that, when provided in the riveting tool, supports the joined part sections during a connection procedure, the die main body having a die front side facing toward a movable punch of the riveting tool, with which a rivet element can be pressed in a punching manner through the joined part sections to be connected; and an embossing section arranged radially inwardly from adjacent areas of the die front side, wherein the embossing section is movable within the die main body between a retracted position and a protruded position where a portion of the embossing section protrudes upwardly in relation to the adjacent areas of the die front side, wherein, when in the protruded position during the connection procedure, the outer surface of the embossing section directly contacts an inner surface of the die main body and causes an embossment in the die-side joined part section, so that components of the joined part material flow into an external depression on the rivet element, wherein the embossing section is implemented as divided into sections that define an axial hole extending through the center of the embossing section to receive slugs that are removed from the at least two joined part sections through action of the rivet element, and wherein the embossing section and the die main body are movable relative to one another, having a gap between the embossing section and the die main body, the gap regionally widening into a receptacle space, so that materials which have penetrated into the gap can be discharged from the gap into the receptacle space.

4. The die according to claim 1, wherein a material interruption is provided at least in the area of the embossing section in such a manner that during the connection procedure, at least a subsection of the embossing section comes into contact on sections of the main body of the die, force peaks in the embossing section which occur during the connection procedure being reducible.

5. The die according to claim 1, wherein the embossing section is divided along the periphery in relation to a central longitudinal axis of the die.

6. The die according to claim 1, wherein two adjacent sections of the embossing section are partially separated by a material interruption and are connected to one another via connection areas.

7. The die according to claim 1, wherein two adjacent sections of the embossing section are completely separated from one another by a continuous material interruption.

8. The die according to claim 1, wherein the embossing section is at least partially slotted in the longitudinal and/or transverse direction.

9. The die according to claim 1, wherein the embossing section is provided on a die element which is movable in the die main body, and which is at least sometimes coupled to an adjustable control element, so that as a function of a position of the control element, the height of the embossing section relative to the adjacent areas of the die front side is changeable.

10. The die according to claim 9, wherein the control element is adapted in such a manner that different predefined heights of the embossing section relative to the adjacent areas of the die front side are continuously settable.

11. The die according to claim 9, wherein the embossing section is implemented in such a manner that the embossing section is at least nearly flush with the die front side in a retracted position of the die element in the die main body.

12. The die according to claim 9, wherein the embossing section is separated from the die element.

13. The die according to claim 9, wherein the control element is mounted perpendicular to a central axis of the die main body such that a direction of the adjustment movement of the control element to change the height of the embossing section is transverse to a direction of the movement of the die element along the central axis of the die main body.

14. The die according to claim 9, wherein when the embossing section is not protruding from the die main body, a base surface of the die element is supported on a floor surface inside the die main body, and the control element is movable between the floor surface and the base surface of the die element to separate the base surface of the die element from the floor surface and change the height of the embossing section.

15. The die according to claim 1, wherein a separation area of a punched slug line, a line section which is moved with the embossed section and a line section fixed thereto are provided, a conical collar section being provided on one line section, which engages in a conical funnel section of the other line section matching with the collar section, the collar section and the funnel section always being provided at least partially overlapping independently of the position of the entrained line section in longitudinal extension of the punched slug line.

16. The die according to claim 1, wherein a spring configuration is provided, by which, if a force load on a front side of the embossing section falls below a predefined force load, the embossing section can be put in a position protruding beyond adjacent areas of the die front side.

17. The die according to claim 1, wherein the spring configuration comprises a leaf spring, which engages from the side on the die element.

18. The die according to claim 1, wherein the embossing section has a front end section, on which a main section of the embossing section adjoins, an external dimension of the main section being greater than an external dimension of the front end section.

* * * * *